US011420809B1

(12) United States Patent
Yellen

(10) Patent No.: US 11,420,809 B1
(45) Date of Patent: Aug. 23, 2022

(54) TISSUE CONTAINER

(71) Applicant: Florange Rental Management, LLC, San Francisco, CA (US)

(72) Inventor: Howard Yellen, San Francisco, CA (US)

(73) Assignee: Florange Rental Management, LLC, San Francisco, CA (US)

( * ) Notice: Subject to any disclaimer, the term of this patent is extended or adjusted under 35 U.S.C. 154(b) by 0 days.

(21) Appl. No.: 17/465,998

(22) Filed: Sep. 3, 2021

Related U.S. Application Data

(60) Provisional application No. 63/260,469, filed on Aug. 20, 2021.

(51) Int. Cl.

| | |
|---|---|
| ***A47K 10/24*** | (2006.01) |
| ***B65D 83/08*** | (2006.01) |
| ***A47K 10/42*** | (2006.01) |
| ***B65D 25/54*** | (2006.01) |
| *A47K 10/32* | (2006.01) |

(52) U.S. Cl.
CPC ..... *B65D 83/0888* (2013.01); *A47K 10/421* (2013.01); *B65D 25/54* (2013.01); *B65D 83/0805* (2013.01); *A47K 2010/3233* (2013.01)

(58) Field of Classification Search
CPC .... B65D 85/48; B65D 85/62; B65D 83/0888; B65D 83/0805; B65D 25/54; A47K 10/421; A47K 2010/3233
USPC ..... 206/449
See application file for complete search history.

(56) References Cited

U.S. PATENT DOCUMENTS

| | | | | |
|---|---|---|---|---|
| 1,988,939 A | | 4/1933 | Craig | |
| 2,915,218 A | | 12/1959 | Rosenman et al. | |
| 3,221,928 A | * | 12/1965 | Horn | A47K 10/421 221/34 |
| 3,265,241 A | | 8/1966 | McColgan | |
| 3,331,498 A | | 7/1967 | Davies | |
| 4,919,302 A | | 4/1990 | McPherson | |
| 5,129,545 A | * | 7/1992 | Parks | B65D 83/0888 221/102 |
| 5,145,062 A | | 9/1992 | Crispi | |
| 5,245,117 A | * | 9/1993 | Withers | A61M 5/3205 206/366 |

(Continued)

*Primary Examiner* — King M Chu
(74) *Attorney, Agent, or Firm* — Renner, Otto, Boisselle & Sklar, LLP

(57) ABSTRACT

A tissue container including a housing, a top opening, a bottom opening, and a membrane disposed inside the housing. The housing has a top wall, a bottom wall, and four side walls between the top and bottom walls. The top opening is in the top wall and tissue can be dispensed therethrough. The bottom opening is in the bottom wall and tissue can be inserted therethrough. The membrane is disposed inside the housing between the top wall and the bottom wall to divide the housing into an upper compartment and a lower compartment. The upper compartment is above the membrane and the lower compartment is below the membrane. The membrane has a center portion and a perimeter portion surrounding the center portion. The perimeter portion may be connected the top wall, the bottom wall, or the four side walls. The center portion is flexibly movable between a first position at which the center portion is closer to the bottom wall than to the top wall and a second position at which the center portion is closer to the top wall than to the bottom wall.

19 Claims, 5 Drawing Sheets

(56) References Cited

U.S. PATENT DOCUMENTS

| | | | | |
|---|---|---|---|---|
| 5,687,875 | A * | 11/1997 | Watts | A47K 10/42 221/102 |
| 2008/0217192 | A1 | 9/2008 | Hickey | |
| 2008/0223867 | A1 | 9/2008 | Carr | |
| 2010/0200439 | A1 | 8/2010 | Laney | |
| 2016/0262582 | A1 | 9/2016 | Henige et al. | |
| 2018/0228321 | A1 | 8/2018 | Kurker | |

* cited by examiner

TISSUE CONTAINER

FIELD OF INVENTION

The present invention relates generally to a tissue container, and more particularly to a tissue container equipped with separate compartments for dispensing of tissue and receiving used tissue.

BACKGROUND

Heretofore, the primary focus in improving tissue containers has been directed to how the tissue container can keep the tissue product contained and how the container can be opened to gain access to the tissue product. When a tissue is used and the user seeks to discard the used tissue, a problem arises if the user is not nearby a trash container. In some instances, the user then sets aside the used tissue on the user's desk, table, floor, etc. until such time a trash container is sufficiently accessible or nearby.

Accordingly, there remains a need for further contributions in this area of technology.

SUMMARY OF INVENTION

According to one aspect of the invention, a tissue container includes a housing having a top wall, a bottom wall, and four side walls between the top and bottom walls; a top opening in the top wall through which tissue can be dispensed; a bottom opening in the bottom wall through which tissue can be inserted; and, a membrane disposed inside the housing between the top wall and the bottom wall to divide the housing into an upper compartment and a lower compartment, wherein the upper compartment is above the membrane and the lower compartment is below the membrane; wherein the membrane has a center portion and a perimeter portion surrounding the center portion, wherein the perimeter portion is connected to one or more of the top wall, the bottom wall, and the four side walls, and the center portion is flexibly movable between a first position at which the center portion is closer to the bottom wall than to the top wall and a second position at which the center portion is closer to the top wall than to the bottom wall.

The membrane may be configured such that in the first position the upper compartment has a larger volume than the lower compartment and in the second position the lower compartment has a larger volume than the upper compartment.

The center portion may have an inverted cup-shaped or dome-shaped configuration.

The center portion is configured in the first position to crumple together to have a relatively shorter inverted cup-shaped or dome-shaped configuration and in the second position to have a relatively taller inverted cup-shaped or dome-shaped configuration.

The membrane may be connected at its perimeter to the perimeter of the bottom wall inside the housing.

The membrane may be connected to the housing to create an airtight seal and moisture resistant seal between the membrane and the housing.

The membrane may be made of a thin flexible sheet of plastic.

The membrane may be made of a polyethylene resin.

The housing may include a window to enable view of the membrane in the housing when the upper compartment is empty of tissue.

The window may be in the top wall of the housing.

The window may include a transparent or translucent plastic film.

The top opening may be in the window.

The tissue container may further include a reclosable door attached to the bottom wall of the housing and configured for movement between a closed position in which the door covers the bottom opening and an open position in which the door exposes the bottom opening such that a tissue can be inserted through the bottom opening.

The reclosable door may include a flap portion and a hinge portion that hinges the flap portion to the bottom wall of the housing, wherein the flap portion has an edge that frictionally engages a portion of the housing to maintain the reclosable door in the closed position.

The bottom wall may include a plastic film and the bottom opening may be in the plastic film.

The plastic film may be configured such that the bottom opening is expandable to enable receipt of a used tissue therethrough into the lower compartment and retractable to narrow the bottom opening to prevent the used tissue from exiting the lower compartment.

The bottom opening may include a slit in the plastic film.

The foregoing and other features of the invention are hereinafter described in greater detail with reference to the accompanying drawings.

DETAILED DESCRIPTION

Figure 1:
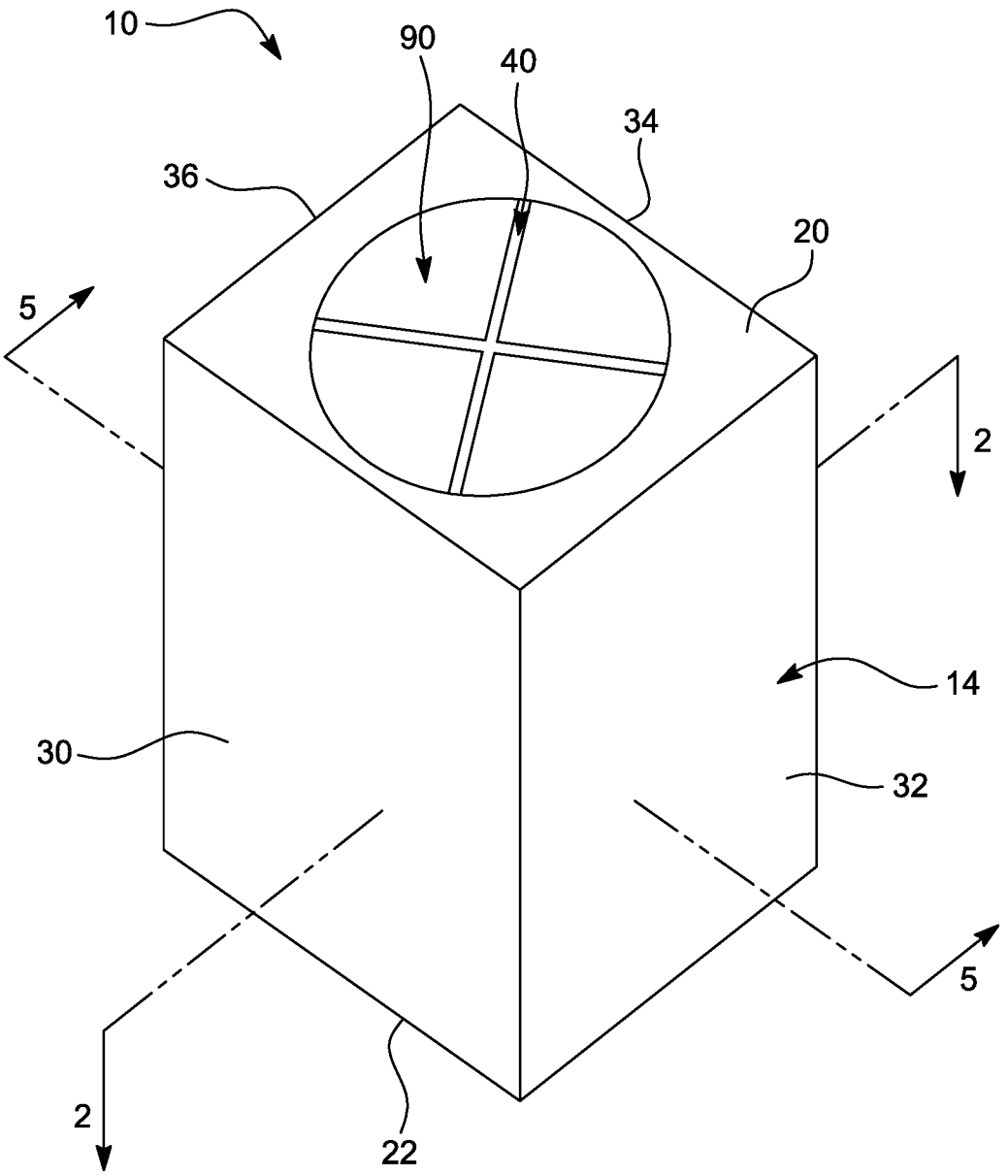
FIG. 1 is a top perspective view of a tissue container according to an embodiment of the invention.

While the present invention can take many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments, and any further applications of the principles of the invention as described herein, are contemplated as would normally occur to one skilled in the art to which the invention relates.

Figure 2:
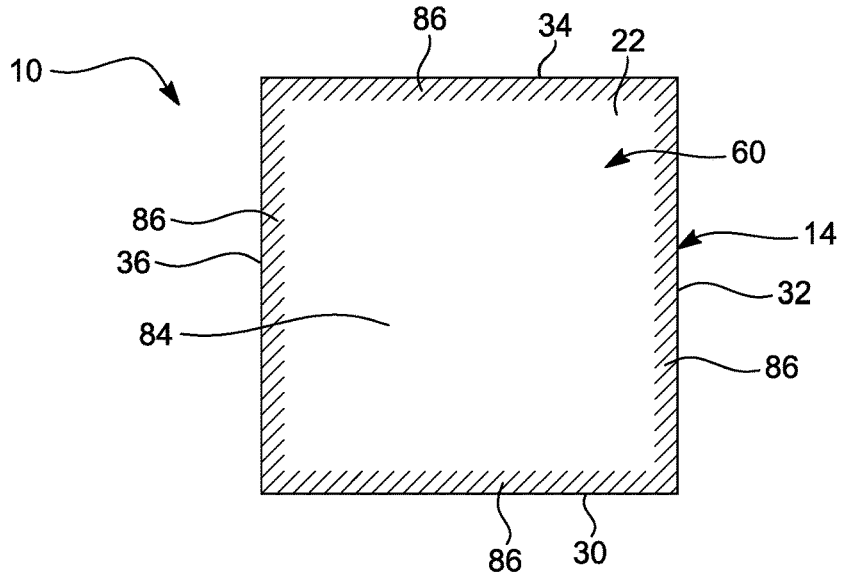
FIG. 2 is a cross section view of the FIG. 1 tissue container as viewed from the plane 2-2 in FIG. 1, showing a center portion of a membrane and a perimeter portion of the membrane.
Figure 3:
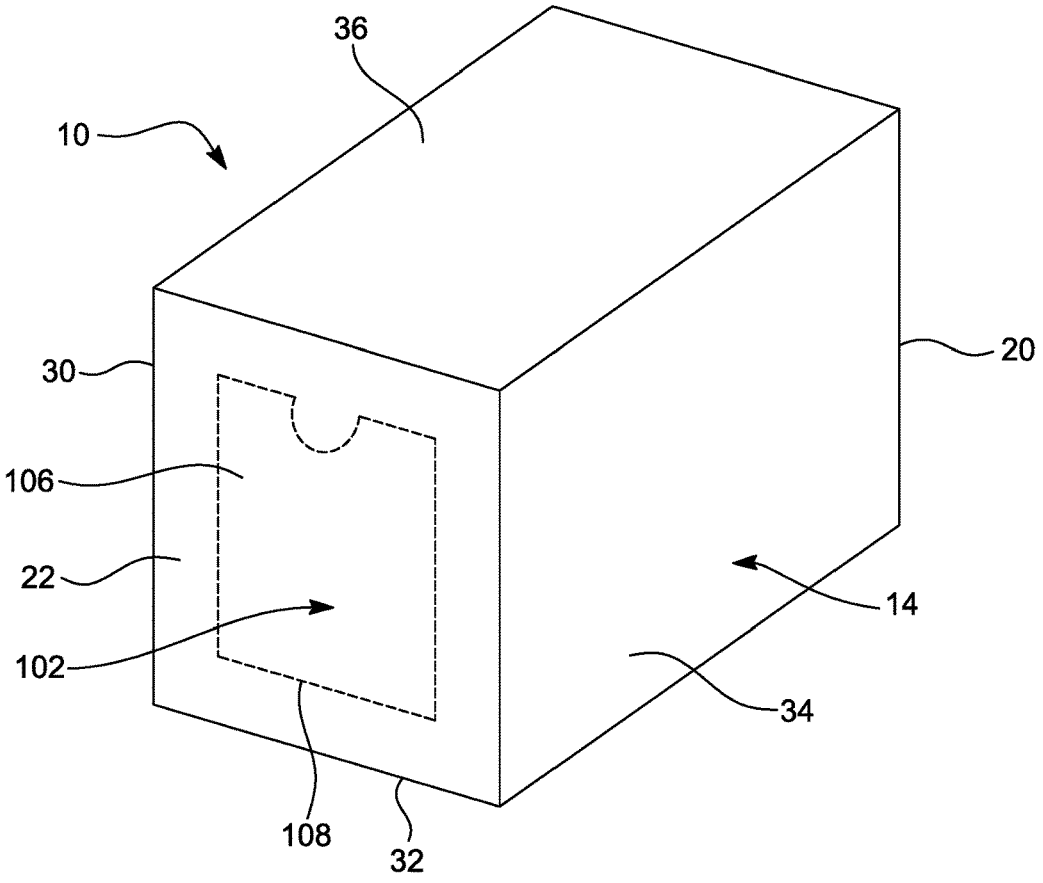
FIG. 3 is a bottom perspective view of the FIG. 1 tissue container, showing a reclosable door in a closed position.
Figure 4:
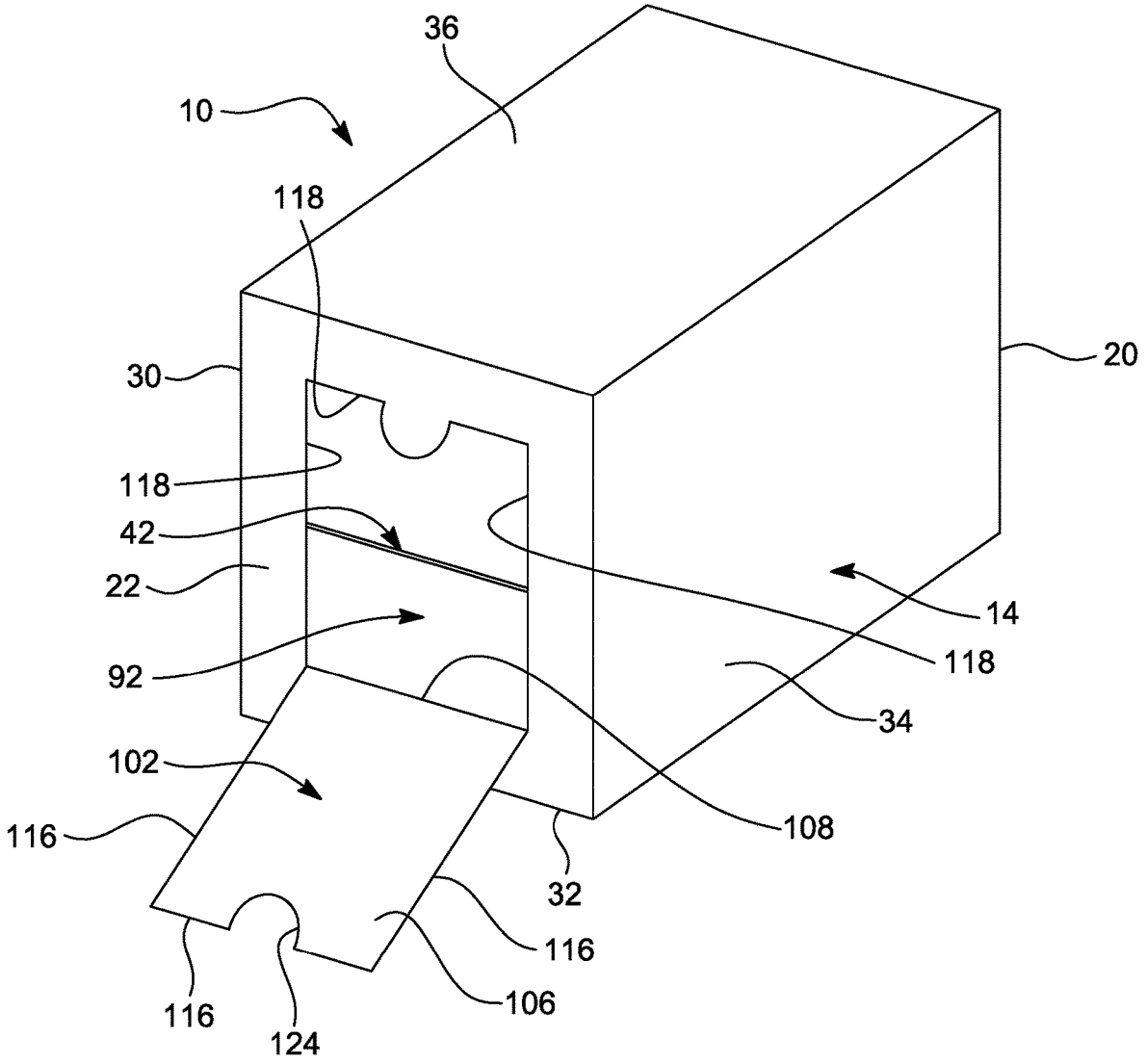
FIG. 4 is a view similar to FIG. 3 except showing the reclosable door in an open position.
Figure 5:
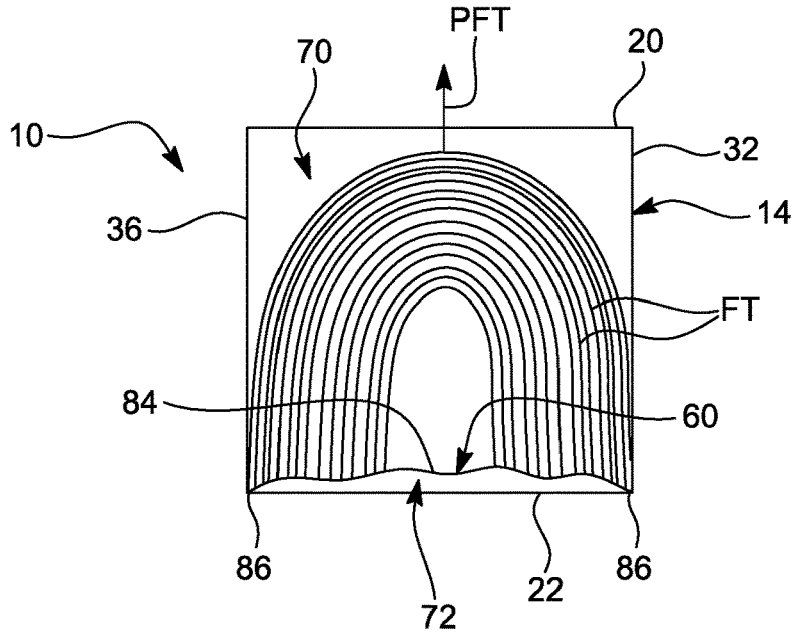
FIG. 5 is a cross section view of the FIG. 1 tissue container as viewed from the plane 5-5 in FIG. 1, wherein fresh tissue is in the upper compartment and no used tissue is in the lower compartment.
Figure 6:
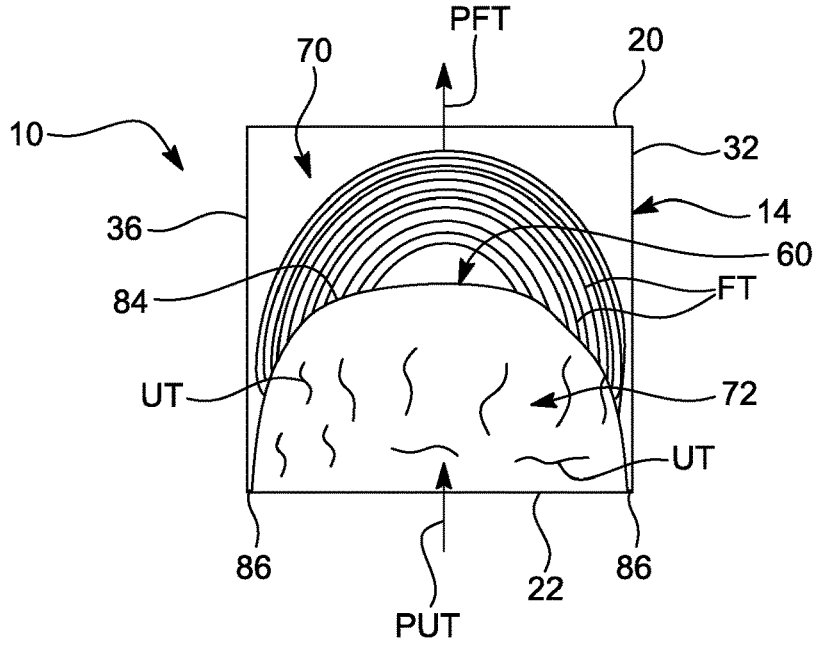
FIG. 6 is a view similar to FIG. 5 except wherein fresh tissue has been removed from the upper compartment and used tissue has been inserted in the lower compartment.
Figure 7:
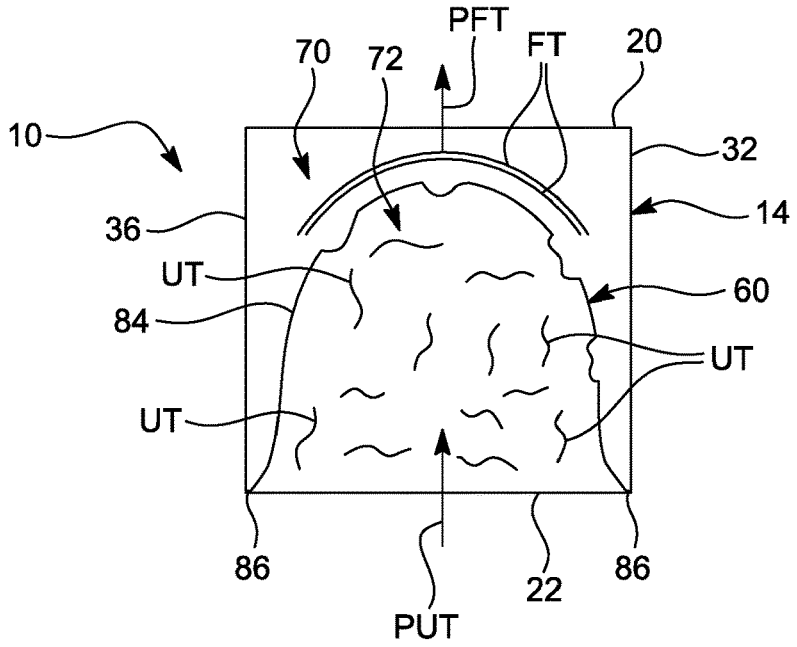
FIG. 7 is a view similar to FIG. 6 except wherein more fresh tissue has been removed from the upper compartment and more used tissue has been inserted in the lower compartment.
Figure 8:
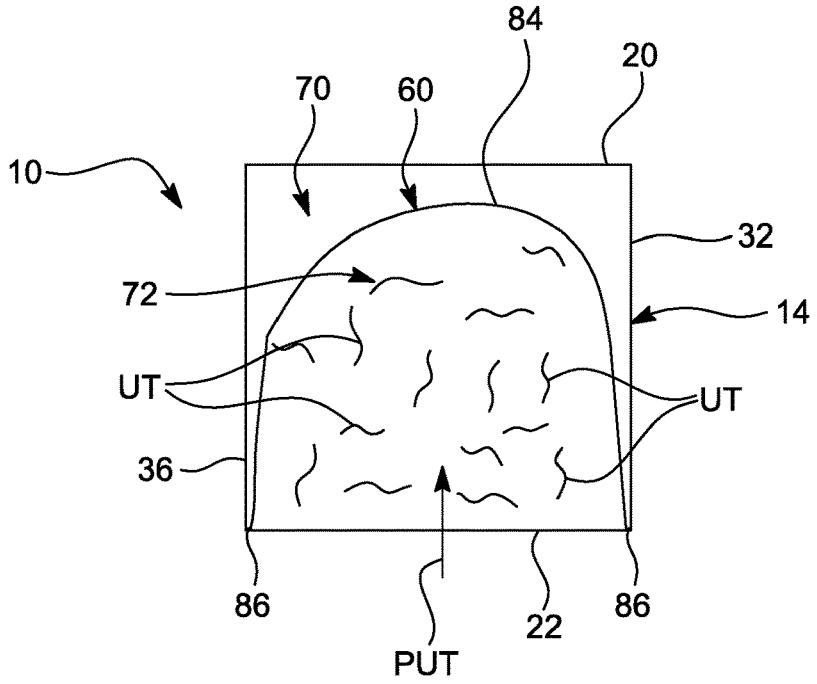
FIG. 8 is a view similar to FIG. 7 except wherein the upper compartment is empty of fresh tissue and still more used tissue has been inserted in the lower compartment.

FIGS. 1-8 show an exemplary tissue container 10 of the invention. As shown in FIGS. 1 and 3, the tissue container 10 includes a housing 14 having a top wall 20, a bottom wall 22, and four side walls 30, 32, 34, 36 between the top wall 20 and the bottom wall 22. A top opening 40 is provided in the top wall 20 and, as shown in FIG. 4, a bottom opening 42 is provided in the bottom wall 22. As shown in FIGS. 5-8, a membrane 60 is disposed inside the housing 14 between the top wall 20 and the bottom wall 22 to divide the housing 14 into an upper compartment 70 and a containment volume or lower compartment 72, wherein the upper compartment 70 is above the membrane 60 and the lower compartment 72 is below the membrane 60. As shown in FIG. 2, the membrane 60 has a center portion 84 and a perimeter portion 86 surrounding the center portion 84. The perimeter portion 86 is shown connected to the bottom wall 22 although it is contemplated that in other embodiments the perimeter portion 86 may be connected to one or more of any of the top wall 20, the bottom wall 22, and the four side walls 30, 32, 34, 36, so long as the membrane 60 divides the housing into upper and lower compartments 70, 72. The center portion 84 is flexibly movable between a first position, for example as shown in FIG. 5, at which the center portion 84 is closer to the bottom wall 22 than to the top wall 20, and a second position, for example as shown in FIGS. 6, 7 and 8, at which the center portion 84 is closer to the top wall 20 than to the bottom wall 22. As shown in FIGS. 5-7, fresh tissue, indicated by reference character FT, inside the housing 14 can be dispensed through the top opening 40 of the housing 14 for example by pulling the fresh tissue FT by the human hand, as shown by arrow PFT. As shown in FIGS. 6-8 and described in greater detail below, once a user has used the tissue, the used tissue, indicated by reference character UT, can be discarded by inserting the used tissue UT through the bottom opening 42 and into the housing 14 for example by pushing the tissue by the human hand, as shown by arrow PUT.

The membrane 60 can be made of any suitable flexible material such as a thin flexible sheet of plastic similar in characteristics as a grocery shopping bag. In one form, the membrane 60 is made of a polyethylene resin. The center portion 84 of the membrane 60 is configured to flex from a crumpled state, for example as shown in FIG. 5, to multiple progressively increasingly less crumpled states, for example as shown in FIGS. 6-8. In a crumpled state, the center portion 84 folds or collapses upon itself bunched up with wrinkles and creases. In an uncrumpled state, the center portion 84 unfolds and exhibits fewer or no wrinkles or creases. In one form, the center portion 84 of the membrane 60 is configured to flex between a relatively low profile as shown in FIG. 5, and to uncrumple, or expand, into a relatively higher profile. For example, FIG. 6 shows the center portion 84 expanded to a relatively higher profile than that shown in FIG. 5; FIG. 7 shows the center portion 84 expanded to a relatively higher profile than that shown in FIG. 6; and FIG. 8 shows the center portion 84 expanded to a relatively higher profile than that shown in FIG. 7. In other embodiments, the membrane 60 may be made of other materials or have other flexibility characteristics. For example, in some embodiments, the membrane 60 may be made of a stretchable material so as to flex by stretching.

In one embodiment, the membrane 60 may be spirally pleated similar to stove top popcorn makers. The membrane 60 may expand into the upper compartment 70 as explained herein by counter-spiraling as it is pressed towards top wall 20 by the used tissue UT being inserted in the lower compartment 72. This is expansion is similar to that of popcorn kernels turning into popcorn in spiral-type stove top popcorn makers.

Turning to FIG. 2, the membrane 60 is connected at its perimeter portion 86 to the perimeter of the bottom wall 22 inside the housing 14. As previously noted, the perimeter portion 86 need not be limited to connection to the bottom wall 22 and other embodiments are contemplated, such as connection to any one or more of the top wall 20, the bottom wall 22, and the four side walls 30, 32, 34, 36. The perimeter portion 86 can be connected to the housing 14 by any suitable means, for example, by an adhesive or glue between the perimeter portion 86 and the housing 14, by double sided tape adhesive between the perimeter portion 86 and the housing 14, by stitching the perimeter portion 86 to the housing 14, or by pinching the perimeter portion 86 between one or more of the housing walls 20, 22, 30, 32, 34, 36. In the illustrated embodiment, the connection between the perimeter portion 86 of the membrane 60 and the perimeter of the bottom wall 22 inside the housing 14 is by means of an adhesive that creates an airtight seal and moisture resistant seal between the perimeter portion 86 and the housing 14. It will be appreciated that the perimeter portion 86 can be connected to the housing 14 by a combination of the foregoing connection or sealing mechanisms.

The perimeter portion 86 of the membrane 60 surrounds the center portion 84 of the membrane 60. The center portion 84 is the flexible portion of the membrane 60 that enables the tissue container 10 to serve as a receptacle for receiving used tissue UT, or tissue that is otherwise desired to be disposed of. The center portion 84 is best shown in FIG. 2 where the center portion 84 extends from the perimeter portion 86 inward toward the geometric center of the housing 14 and more particularly the geometric center of the four side walls 30, 32, 34, 36. The center portion 84 also is shown in side cross section view in FIG. 5 in a crumpled state, in FIGS. 6 and 7 in partially crumpled partially expanded states, and in FIG. 8 in an uncrumpled or fully expanded state. In the illustrated embodiment, the center portion 84 has an inverted cup-shaped or dome-shaped configuration, where the height of this inverted cup-shape or dome shape is most shallow in FIG. 5 and deepest in FIG. 8. Thus, the center portion 84 is flexibly movable such that it can take the FIG. 5 position where the center portion 84 is crumpled together to have a relatively shorter inverted cup-shaped or dome-shaped configuration and also take the FIGS. 6-8 positions where the center portion 84 has a relatively taller inverted cup-shaped or dome-shaped configuration.

The membrane 60 enables the upper compartment 70 that holds the fresh tissues FT for dispensing to contract and the lower compartment 72 that receives used tissues UT to expand. Thus, the membrane 60 is configured such that in the FIGS. 5 and 6 positions the upper compartment 70 has a larger volume than the lower compartment 72, and such that in the FIGS. 7 and 8 positions the lower compartment 72 has a larger volume than the upper compartment 70. Advantageously, this allows the tissue container 10 to serve two purposes, both a dispensing container purpose and a sanitary waste container purpose, while occupying only a volume for one purpose, that of a dispensing container. There may have been tissue containers in the prior art that allow used tissue disposal. However, none of those prior art solutions allowed for the sanitary disposal of used tissues UT as does the membrane 60 of the present invention that truly shields the fresh, unused tissues FT from the used ones UT. The tissue container 10 keeps potentially germ-filled, used tissues UT separated in a sanitary way from fresh, clean ones FT. This is useful because more than one person likely uses tissues from the tissue container 10.

In the present invention, the size or form factor of the container 10 does not change from the point the container 10 only has therein fresh tissue FT to the point where the container 10 only has therein used tissue UT. Some prior art tissue containers had to grow in volume to accommodate used tissue disposal. Not the container 10. This is not only an advantage for manufacturing, shipping, and shelf placement, but also many people put a decorative cover on tissue boxes and changed sizes would render them unusable.

The present invention is also advantageous from a quantity of materials perspective since most of the materials that enable the tissue container 10 to function as a dispensing container also enable the tissue container 10 to function as a waste container. For example, the top wall 20, the bottom wall 22, and the four side walls 30, 32, 34, 36 of the tissue container 10 serve to contain both fresh tissue FT and used tissue UT. Moreover, the container 10, unlike some prior art solutions, allow for components of the container 10, including the membrane 60 attached to the side walls 30, 32, 34, 36 or other portions of the housing 14 to remain as one assembly, easy to toss out in one step and not multiple independent pieces of paper, cardboard, etc. In one embodiment, the membrane 60 may be made of biodegradable plastic so the whole container 10 may biodegrade when disposed of.

The walls 20, 22, 30, 32, 34, 36 of the housing 14 are made of cardboard except to accommodate various features noted herein. Referring to FIG. 1, the top wall 20 includes a window 90 to enable view of the membrane 60 in the housing 14 when the upper compartment 70 is empty of fresh tissue FT. The window 90 can include a plastic film 90, as illustrated, connected to the remainder of the top wall 20, i.e., the cardboard portion of the top wall 20, or the window 90 can merely be an opening in the top wall 20. In one form, the window 90 includes a transparent or translucent plastic film. The plastic film may have a color for example green. The window 90 can take any size or shape and be located at any portion of the top wall 20. In the illustrated embodiment, the window 90 is circular in shape, centered in the top wall 20, and occupies approximately 80-90% of the width of the top wall 20. In other embodiments, the window 90 may be other than circular in shape, for example oblong or rectangular, and/or may be located in one of the side walls 30, 32, 34, 36 or in a combination of the top wall 20 and one or more of the side walls 30, 32, 34, 36.

In the illustrated embodiment, the top opening 40 is built into the window 90. Thus, the window 90 acts both as a window and support structure for the top opening 40. As shown in FIG. 1, the top opening 40 includes a four slit configuration. As will be appreciated, the window 90 may be separate from the top opening 40. For example, the window 90, whether a plastic film or merely an opening, may be in a side wall 30, 32, 34, 36 while the top opening 40 is in the top wall 20. Also, the top opening 40 need not be in a plastic film or have a four slit configuration. Other embodiments are contemplated, for example, the top opening 40 may simply be an opening in the cardboard structure of the top wall 20 and may have for example an elongated curved configuration sized to enable a fresh tissue FT to be pulled therethrough.

Turning to FIG. 4, the bottom wall 22 includes a window 92 to enable view of the membrane 60 in the housing 14 when the lower compartment 72 does not contain any used tissue UT, that is, before inserting the first used tissue UT in the lower compartment 72. The window 92 can include a plastic film 92, as illustrated, connected to the remainder of the bottom wall 22, i.e., the cardboard portion of the bottom wall 22, or the window 92 can merely be an opening in the bottom wall 22. In one form, the window 92 includes a transparent or translucent plastic film. The plastic film may have a color for example red. The window 92 can take any size or shape and be located at any portion of the bottom wall 22. In the illustrated embodiment, the window 92 is rectangular in shape, centered in the bottom wall 22, and occupies approximately 50-90% of the width of the bottom wall 22. In other embodiments, the window 92 may be other than rectangular in shape, for example oblong or circular, and/or may be located in one of the side walls 30, 32, 34, 36 or in a combination of the bottom wall 22 and one or more of the side walls 30, 32, 34, 36. The window 92 may also be made of an elastic material.

In the illustrated embodiment, the bottom opening 42 is built into the window 92. Thus, the window 92 acts both as a window and support structure for the bottom opening 42. As shown in FIG. 4, the bottom opening 42 includes a slit configuration. In one form, the plastic film 92 may be configured such that the bottom opening 42 is expandable to enable receipt of a used tissue UT therethrough into the lower compartment 72 and retractable to narrow the bottom opening 42 to prevent the used tissue UT from exiting the lower compartment 72. As will be appreciated, the window 92 may be separate from the bottom opening 42. For example, the window 92, whether a plastic film or merely an opening, may be in a side wall 30, 32, 34, 36 while the bottom opening 42 is in the bottom wall 22. Also, the bottom opening 42 need not be in a plastic film or have a slit configuration. Other embodiments are contemplated, for example, the bottom opening 42 may simply be a round opening in the cardboard structure of the bottom wall 22 sized to enable a used tissue UT to be inserted therethrough.

In accordance with an embodiment of the invention, the top window 90 and the bottom window 92 have one or more of a different size, a different shape, and/or a different color. For example, in the illustrated embodiment, the top window 90 is larger than the bottom window 92; the top window 90 is circular in shape and the bottom window 92 is rectangular in shape; and the top window 90 has a green color and the bottom window 92 has a red color. These differences aid in alerting the user as to which end, i.e., top or bottom, of the tissue container 10 is upright.

In accordance with another embodiment of the invention, the top opening 40 and the bottom opening 42 have one or more of a different size, a different shape, and/or a different configuration. For example, in the illustrated embodiment, the top opening 40 spans a greater percentage of the width of the top wall 20 than does the bottom opening 42 span the width of the bottom wall 22; the top opening 40 is sized to enable a fresh tissue FT to pass therethrough and/or to enable the fingers of the hand to fit into the housing 14 to grasp a fresh tissue FT whereas the bottom opening 42 is sized to receive a used tissue UT therethrough; and the top opening 40 has a four slit configuration and the bottom opening 42 has a single slit configuration. These differences likewise aid in alerting the user as to which end, i.e., top or bottom, of the tissue container 10 is upright.

Turning now to FIGS. 3 and 4, the tissue container 10 may also include a reclosable door 102 attached to the bottom wall 22 of the housing 14 and configured for movement between a closed position (FIG. 3) in which the door 102 covers the bottom opening 42 and an open position (FIG. 4) in which the door 102 exposes the bottom opening 42 such that a tissue can be inserted through the bottom opening 42.

In the illustrated embodiment, the reclosable door 102 includes a flap portion 106 and a hinge portion 108 that hinges the flap portion 106 to the bottom wall 22 of the housing 14. The hinge portion 108 may be a pre-folded crease on the bottom wall 22. The flap portion 106 edges 116 that frictionally engage conforming edges 118 of the housing 14 to maintain the reclosable door 102 in the closed position. A finger cutout 124 may be provided in the flap portion 106 to facilitate easy opening and closing of the flap portion 106 by a finger of the hand. In one form, the reclosable door 102 may be labeled "used tissue", "waste", or with an icon of a waste paper basket or the like, to denote the bottom of the tissue container 10 as a receptacle for used tissue UT. In another embodiment, the door 102, although have an area similar to the top window 90, may simply be shaped (e.g., rectangular, tabbed, etc.) differently from the top window 90 to indicate to user which side is for disposing of used tissue. The container 10, therefore, doubly prevents used tissue UT (or matter attached thereto) from escaping the container 10: the window 92 and the door 102.

In one embodiment, the housing 14 may include a see-through strip forming a window on one or more of the four side walls 30, 32, 34, 36 such that the user may see "progress" of how many fresh tissues FT remain or how many used tissues UT there are in the container 10. In one embodiment, the membrane 60 is opaque or translucent so that the membrane 60 may be seen through the window.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A tissue container, comprising:

a housing having a top wall, a bottom wall, and four side walls between the top and bottom walls;

a top opening in the top wall through which fresh tissue can be dispensed;

a bottom opening in the bottom wall through which used tissue can be inserted;

a membrane disposed inside the housing between the top wall and the bottom wall to divide the housing into an upper compartment and a lower compartment, wherein the upper compartment is above the membrane and the lower compartment is below the membrane;

wherein the membrane has a center portion and a perimeter portion surrounding the center portion, wherein the perimeter portion is connected to one or more of the top wall, the bottom wall, and the four side walls, and the center portion is flexibly movable between a first position at which the center portion is closer to the bottom wall than to the top wall and a second position at which the center portion is closer to the top wall than to the bottom wall; and a reclosable door attached to the bottom wall of the housing and configured for movement between a closed position in which the door covers the bottom opening and an open position in which the door exposes the bottom opening such that a tissue can be inserted through the bottom opening.

2. The tissue container according to claim 1, wherein the membrane is configured such that in the first position the upper compartment has a larger volume than the lower compartment and in the second position the lower compartment has a larger volume than the upper compartment.

3. The tissue container according to claim 1, wherein the center portion has an inverted cup-shaped or dome-shaped configuration.

4. The tissue container according to claim 1, wherein the center portion is configured in the first position crumpled together in an inverted cup-shaped or dome-shaped configuration and in the second position to have an inverted cup-shaped or dome-shaped configuration taller than the inverted cup-shaped or dome-shaped configuration of the first position.

5. The tissue container according to claim 1, wherein the membrane is connected at its perimeter to the perimeter of the bottom wall inside the housing.

6. The tissue container according to claim 1, wherein the membrane is connected to the housing to create an airtight seal and moisture resistant seal between the membrane and the housing.

7. The tissue container according to claim 1, wherein the membrane is made of a thin flexible sheet of plastic.

8. The tissue container according to claim 1, wherein the membrane is made of a polyethylene resin.

9. The tissue container according to claim 1, wherein the housing includes a window to enable view of the membrane in the housing when the upper compartment is empty of tissue.

10. The tissue container according to claim 9, wherein the window includes a transparent or translucent plastic film.

11. The tissue container according to claim 9, wherein the top opening is in the window.

12. The tissue container according to claim 1, wherein the reclosable door includes a flap portion and a hinge portion that hinges the flap portion to the bottom wall of the housing, wherein the flap portion has an edge that frictionally engages a portion of the housing to maintain the reclosable door in the closed position.

13. The tissue container according to claim 1, wherein the bottom wall includes a plastic film and the bottom opening is in the plastic film.

14. The tissue container according to claim 13, wherein the plastic film is configured such that the bottom opening is expandable to enable receipt of a used tissue therethrough into the lower compartment and retractable to narrow the bottom opening to prevent the used tissue from exiting the lower compartment.

15. The tissue container according to claim 13, wherein the bottom opening comprises a slit in the plastic film.

16. A tissue container, comprising:

a housing having a top wall, a bottom wall, and four side walls between the top and bottom walls;

a top opening in the top wall through which fresh tissue can be dispensed;

a bottom opening in the bottom wall through which used tissue can be inserted;

a membrane disposed inside the housing between the top wall and the bottom wall to divide the housing into an upper compartment and a lower compartment, wherein the upper compartment is above the membrane and the lower compartment is below the membrane;

wherein the membrane has a center portion and a perimeter portion surrounding the center portion, wherein the perimeter portion is connected to one or more of the top wall, the bottom wall, and the four side walls, and the center portion is flexibly movable between a first position at which the center portion is closer to the bottom wall than to the top wall and a second position at which the center portion is closer to the top wall than to the bottom wall, wherein the housing includes a window to enable view of the membrane in the housing when the upper compartment is empty of tissue, wherein the window is in the top wall of the housing.

17. A tissue container, comprising:

a housing having a top wall, a bottom wall, and four side walls between the top and bottom walls;

a first opening through which fresh tissue can be dispensed;

a second opening through which used tissue can be inserted;

a membrane disposed inside the housing to divide the housing into a first compartment and a second compartment;

wherein the membrane has a center portion and a perimeter portion surrounding the center portion, wherein the perimeter portion is connected to one or more of the top wall, the bottom wall, and the four side walls, and the center portion is flexibly movable between a first position at which the center portion is closer to the first opening than to the second opening and a second position at which the center portion is closer to the second opening than to the first opening; and the bottom wall includes a plastic film and the second opening is in the plastic film.

18. The tissue container according to claim 17, wherein the plastic film is configured such that the bottom opening is expandable to enable receipt of a used tissue therethrough into the lower compartment and retractable to narrow the bottom opening to prevent the used tissue from exiting the lower compartment.

19. The tissue container according to claim 17, wherein the bottom opening comprises a slit in the plastic film.

* * * * *